US005419751A

United States Patent [19]

Byrd et al.

[11] Patent Number: 5,419,751

[45] Date of Patent: May 30, 1995

[54] MULTI-FUNCTION EXERCISE APPARATUS

[75] Inventors: Rick Byrd; Kevin Gerschefske, both of Springfield; William C. Brazeal, Mansfield, all of Mo.

[73] Assignee: Stamina Products, Inc., Springfield, Mo.

[21] Appl. No.: 145,202

[22] Filed: Oct. 28, 1993

[51] Int. Cl.[6] ..... A63B 21/00

[52] U.S. Cl. ..... 482/138; 482/94; 482/142; 482/53

[58] Field of Search ..... 482/138, 135, 136, 137, 482/97, 98, 99, 100, 52, 53, 142

[56] References Cited

U.S. PATENT DOCUMENTS

| | | | |
|---|---|---|---|
| Re. 28,066 | 7/1974 | Marcyan . | |
| D. 263,978 | 4/1982 | Brentham . | |
| 3,116,062 | 12/1963 | Zinkin . | |
| 3,708,167 | 1/1973 | Potgieter . | |
| 4,072,309 | 2/1978 | Wilson . | |
| B1 4,072,309 | 3/1984 | Wilson . | |
| 4,422,636 | 12/1983 | de Angeli . | |
| 4,429,871 | 2/1984 | Flechner . | |
| 4,492,375 | 1/1985 | Connelly . | |
| 4,509,745 | 4/1985 | Angsten . | |
| 4,563,001 | 1/1986 | Terauds . | |
| 4,582,320 | 4/1986 | Shaw . | |
| 4,600,189 | 7/1986 | Olschansky et al. | 482/137 |
| 4,606,540 | 8/1986 | Chin-Sen . | |
| 4,614,338 | 9/1986 | Castillo . | |
| 4,618,144 | 10/1986 | Gibson . | |
| 4,627,614 | 12/1986 | de Angeli . | |
| 4,640,268 | 2/1987 | Roberts . | |
| 4,709,920 | 12/1987 | Schnell . | |
| 4,721,303 | 1/1988 | Fitzpatrick . | |
| 4,722,525 | 2/1988 | Brentham . | |
| 4,763,897 | 8/1988 | Yakata | 482/137 |
| 4,834,367 | 5/1989 | Salyer et al. . | |
| 4,893,812 | 1/1990 | Dawson, Jr. et al. . | |
| 4,900,018 | 2/1990 | Ish, III et al. . | |
| 4,915,377 | 4/1990 | Malnke et al. . | |
| 4,940,233 | 7/1990 | Bull et al. . | |
| 4,964,632 | 10/1990 | Rockwell . | |
| 4,979,736 | 12/1990 | Maynard . | |
| 4,986,538 | 1/1991 | Ish, III . | |
| 5,004,224 | 4/1991 | Wang . | |
| 5,080,351 | 1/1992 | Rockwell . | |
| 5,135,451 | 8/1992 | Chen . | |
| 5,236,406 | 8/1993 | Webber | 482/138 |
| 5,277,684 | 1/1994 | Harris . | |
| 5,308,304 | 5/1994 | Habing . | |

FOREIGN PATENT DOCUMENTS

| | | |
|---|---|---|
| 2524329 | 10/1983 | France . |
| 8005681 | 10/1980 | Germany . |

OTHER PUBLICATIONS

Flex CTS Owner's manual, Mar. 1990.

*Primary Examiner*—Richard J. Apley
*Assistant Examiner*—Lynne A. Reichard
*Attorney, Agent, or Firm*—Kokjer, Kircher, Bowman & Johnson

[57] ABSTRACT

A multiple function exercise apparatus comprises a frame for supporting a resistance assembly such as a guided weight assembly. A cam is pivotally mounted on the frame and is operably connected to the resistance assembly. A handlebar may be attached to said cam in one of a plurality of fixed resting positions. In one mode of operation, movement of the handlebar in a first direction causes the cam to pivot in a first direction thereby moving the resistance assembly from its resting position. In another mode of operation, the movement of the handlebar in a second direction opposite the first direction causes the cam to likewise pivot in a second direction opposite the first rotational direction thereby moving the resistance assembly from its resting position. In yet another mode of operation, the cam may be locked in a fixed position. A cable connected at one end to a moveable mechanism and at the other end to the resistance assembly slidingly engages a spool located on the cam during movement of the moveable mechanism. A climbing mechanism is also provided on the frame.

35 Claims, 3 Drawing Sheets

MULTI-FUNCTION EXERCISE APPARATUS

BACKGROUND OF THE INVENTION

1. Field of the Invention

The present invention relates in general to an exercise apparatus. Particularly, the present invention relates to an improved exercising machine having components for the performance of multiple physical exercises.

2. Description of the Related Art

The variety of weight-training devices available today is a tribute to the increasingly recognized importance and popularity of physical fitness. In response to the growing demand for exercise machines capable of performing a variety of functions, many types of multi-function exercise devices have been developed which have components for the performance of a variety of physical exercises.

Many exercising devices of the foregoing type are large cumbersome machines having individual stations for the performance of different exercises. The overall size and the number of components used in these types of machines makes them costly, largely inappropriate for use in many areas, and additionally, makes their transportation, once assembled, difficult. Many efforts have been made to reduce the size of multi-function exercise devices, often resulting in exercise machines which sacrifice the machine's ability to afford a complete workout.

Further, prior art machines are typically encumbered with one or more of a variety of complicated arrangements for coupling a lifting mechanism to a stack of weights or other resistance means. Traditionally, as the number of possibilities for performing exercises on an exercise machine increased, the number of components necessary to complete the machine also increased, thereby resulting in a costlier, heavier, more spacious and complex exercising device.

Additionally, properly performing a physical exercise depends in large part upon the proper positioning of the individual during the performance of the exercise, and upon appropriate motion of the individual's body and appendages required to be used for the particular exercise being performed. Moreover, it has become well-recognized that an overall physical conditioning program includes, in addition to adequate rest and proper nutrition, a variety of factors such as flexibility, cardiovascular training, and strength training.

Accordingly, the need exists for a multi-function exercise apparatus that facilitates proper performance of a variety of physical exercises and for permitting the user to achieve the advantages of weight training, aerobic training, and flexibility, in a weight training device having relatively few components. Additionally, the need exists for an exercise machine that is easily converted by the user from one mode of operation to a second mode of operation. Further still, the need exists for an exercise machine which permits the performance of a variety of physical exercises without the presence of numerous moving parts, complex links, pulleys, and other components as commonly found in the prior art. The present invention fills these and other needs by providing a multiple function exercise machine that permits the proper performance of a variety of physical exercises with a minimal number of components.

SUMMARY OF THE INVENTION

An overall object of the present invention is to provide an inexpensive and efficient exercise machine for performing multiple physical exercises.

Another object of the present invention is to provide an exercise machine which is designed to improve the user's strength, flexibility, and cardiovascular fitness.

Another object of the present invention is to provide a multiple-function exercise machine which is easy to convert from one mode of operation to another mode of operation.

Still another object of the present invention is to provide an exercise machine which permits the user to perform of a variety of exercises with the same components of the machine.

Another principle object of the present invention is to provide a machine with a relatively small number of components for performing a variety of weight-lifting exercises.

Another object of the present invention is to provide a multi-function exercise apparatus whereby rotational movement of a pivotal cam in either a first or second direction during the performance of weight-lifting exercises actuates a resistance assembly.

These and other objects are achieved by a multi-function exercise apparatus comprised generally of a frame including a base having first and second upwardly extending beams. Mounted to the first upright beam is a removable seat in which the user can sit during the performance of certain exercises. Alternatively, the user can remove and set aside the seat for performing other exercises. The second upright beam and the base support a climbing mechanism, described below in detail. A central upright beam extends upwardly from the base at a location intermediate the first and second upright beams and serves as a guide for a weight assembly which moves up and down along the central beam during the performance of weight-lifting exercises.

In accordance with the principles of the present invention, a cam is pivotally mounted over the frame. A handlebar assembly for use during weight-lifting exercises is pivotally fastened to an outer peripheral portion of the cam. The handlebar may be engaged with the cam in one of a plurality of fixed positions, as selected by the user, by placing a pin through one of a plurality of apertures in the cam and an aperture in the handlebar assembly. Each fixed position of the handlebar results in the handlebar having a different resting location. In this way, the starting location of the handlebar is adjustable as necessitated for the performance of different exercises or as desired by different users. Once the starting handlebar position is chosen, and appropriate engagement of the handlebar to the cam is made by placing the pin through the aperture in the handlebar assembly and an appropriate aperture in the cam, movement of the handlebar assembly will cause the cam to rotate about its pivotal mounting location on the frame.

A spool is axially mounted at a location on the cam such that the spool is at a lower end of the cam when the cam is in a resting position. As described more fully below, the spool is free to rotate and receives in its outer peripheral groove a portion of the cable used in connection with weight lifting maneuvers.

In accordance with further principles of the present invention, a single cable is utilized to facilitate movement of the weight assembly during the performance of all weight lifting exercises performed on the exercising machine. A first end of the cable is attached to the weight assembly. From here, the cable is guided upwardly through a guide assembly, located above the central beam and between the first and second beams, and about the spool at the lower end of the cam. Next, the cable extends back downwardly through the guide assembly to the lower end of the frame. The second end of the cable may be connected to a leg-extension assembly mounted on the seat or, alternatively, the second end of the cable may be left free for attachment to a bar or other means for performing various exercises. If the cable is left free from connection, a stopper on the cable engages a portion of the frame to prevent the taut cable from retracting back towards the weight assembly.

As will be described more fully below with reference to the drawings, movement of the handlebar from its resting position in a first direction will cause rotation of the cam in a first direction. As the cam rotates, the spool on the cam moves from its resting position thereby pulling on the cable. As the cable is drawn with the spool, the weight assembly rises from its resting position. Similarly, movement of the handlebar in a second direction, opposite the first direction, will likewise cause the cam to rotate in a second direction, opposite its first direction of rotation. Again, as the cam rotates in response to movement of the handlebar, the spool thereon moves from its resting position, albeit in a direction opposite that described with respect to movement of the handlebar assembly in a first direction, and the weight assembly rises from its resting position.

In another mode of operation, the cam is locked to prevent it from pivoting. In this mode, pulling the second end of the cable (i.e., the end of the cable opposite the resistance assembly) will cause the cable to be drawn and the weights to be lifted. Particularly, the cable is drawn through the guide assembly at a first location, about the spool on the stabilized cam, and through the guide assembly at a second location for lifting the weight assembly. In this mode, leg exercises and various upper body exercises may be performed with the exercise machine.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 2:
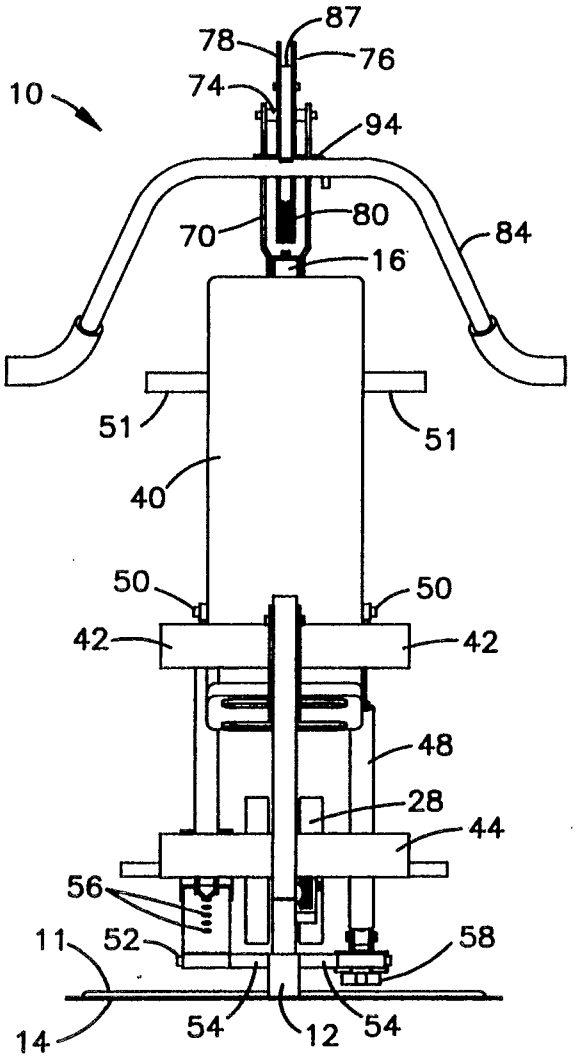
FIG. 2 is a front elevational view thereof.
Figure 1:
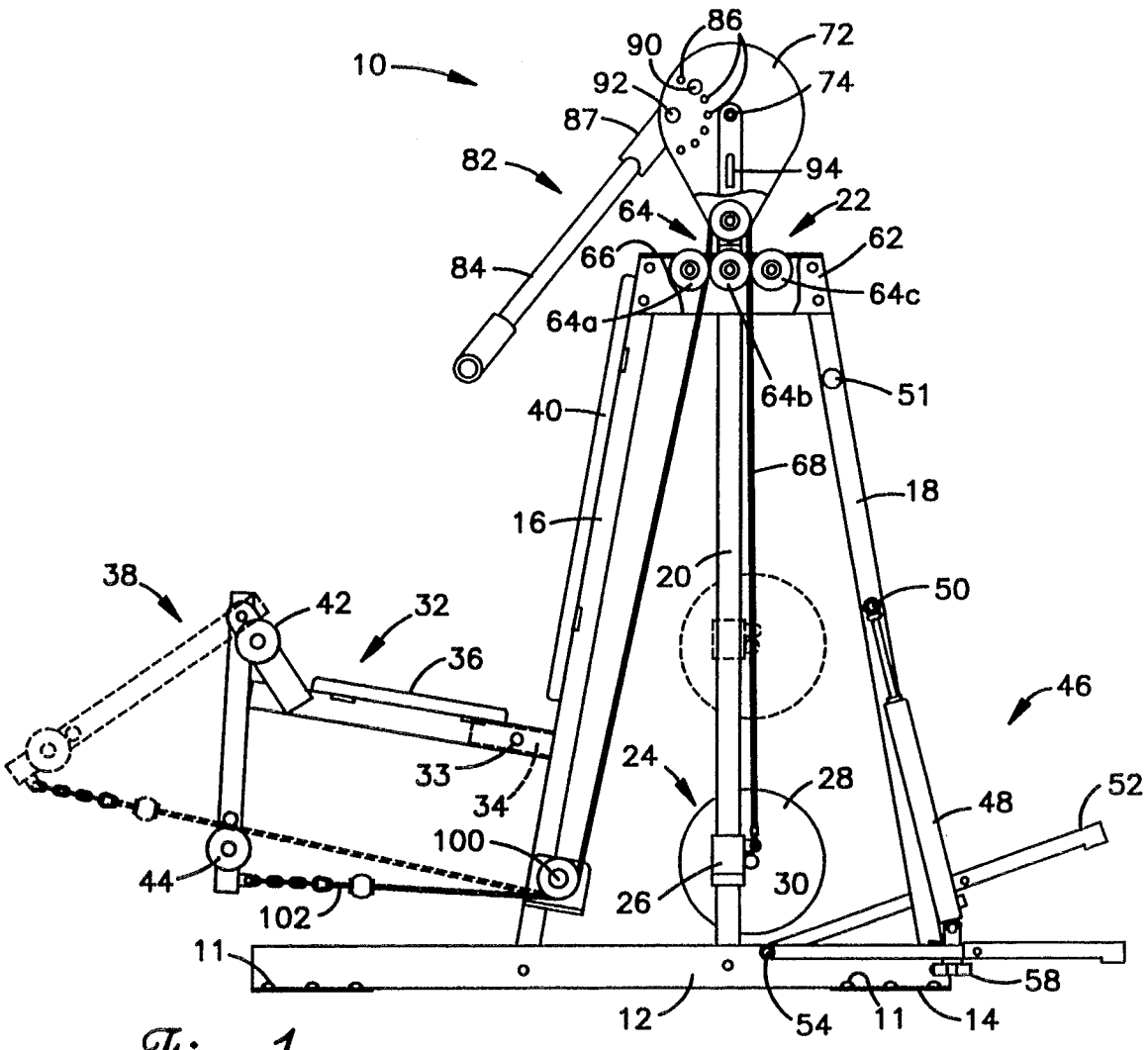
FIG. 1 is a right side elevational view of the preferred embodiment of the exercising machine of the present invention.
Figure 3:
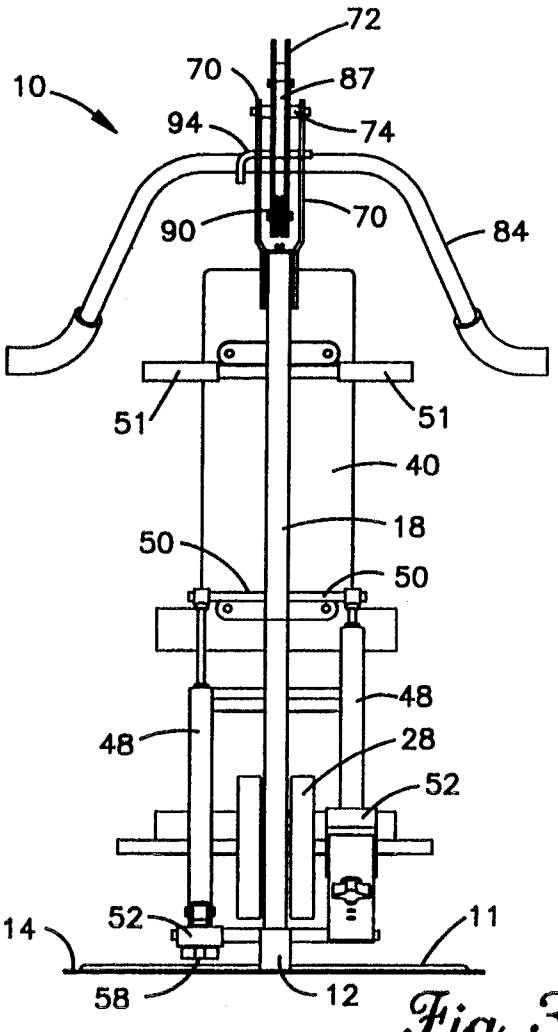
FIG. 3 is a rear elevational view thereof.

With reference initially to FIGS. 1–3, the preferred embodiment of the multiple function exercising machine of the present invention is denoted generally by reference numeral 10. Exercise machine 10 has a frame generally comprising a base member 12, a pair of feet members 14, a frontal upwardly extending beam 16, a rearward upwardly extending beam 18, a central upwardly extending beam 20 disposed on base member 12 at a location intermediate frontal beam 16 and rearward beam 18, and a bridge assembly 22 for bridging together the upper ends of beams 16, 18, and 20.

A weight assembly 24 is adapted to slidingly engage with central upright beam 20 during the performance of exercises. In the embodiment shown, weight assembly 24 comprises a collar 26 having a weight 28 mounted on rod 30 extending outwardly from collar 26. Various resistance means are known in the art and it will be appreciated that weight assembly 24 may comprise any of various forms of resistance means, such as a weights in a stack separable by a pin, elastic straps or bands, or piston assemblies and the like. In this regard, it will be understood that various resistance means or mechanisms can be substituted for that shown without departing from the spirit and scope of the present invention.

More particularly, base member 12 preferably consists of a beam. Feet members 14 are preferably located at substantially opposite ends of base member 12 and extend laterally outward with respect to base member 12. Feet members 14 stabilize exercising machine 10 and cooperate with base member 12 to support machine 10. Additionally, feet members preferably have one or more raised projections 11 for providing traction to a user of machine 10 standing thereon during the performance of various exercises.

A seat assembly 32 is releasably mounted by pin 33 to frontal upright member 16. Particularly, seat assembly 32 is comprised of a seat support beam 34 extending outwardly from upright member 16. A seat cushion 36 is positioned substantially symmetrically thereon. A backrest 40 is located substantially symmetrically with respect to frontal upright beam 16. A leg extension assembly 38 is positioned at substantially the outermost end of seat assembly 32. Operation of leg extension assembly 38 will be readily understood by those familiar with this physical exercise. In general, a person seated on seat cushion 36 with his back against backrest 40 places the lower portion of his thighs (i.e., just above the knees) beneath thigh pads 42. The ankles are positioned behind ankle pads 44. The legs may then be extended outwardly against the resistance of weight assembly 24.

A climbing mechanism 46 is provided having pistons 48 that are mounted between respective upper piston support rods 50 and climbing pedals 52. Pedals 52 are pivotally attached to pedal support rods 54 located on base member 12. Each pedal 52 has a plurality of apertures 56 located therein at which its respective piston 48 may be selectively engaged by means of coupling unit 58. Climber hand grips 51 are provided for grasping by the user during performance of a climbing exercise. It will be appreciated that appropriate adjustments can be made with coupling unit 58 to alter the location at which each pedal 52 engages with its respective piston 48 to increase the range of movement of pedals 52, and hence, the difficulty of the climbing exercise.

With reference primarily to FIG. 1, bridge assembly 22 is described. Bridge assembly 22 forms the upper portion of the frame of exercise machine 10. Particularly, a plate 62 extends between frontal upright beam 16 and rearward upright beam 18 along each side edge of the frame at substantially the upper end thereof. The nearest plate 62 in FIG. 1 is shown broken away to reveal a plurality of pulley-type wheels, or spools, 64. Preferably, three such wheels, denoted by reference numerals 64*a*, 64*b*, and 64*c*, are provided. An upper cap portion 66 is mounted over the top of the frame such that it rests on the uppermost portions of frontal upright beam 16 and rearward upright beam 18. Upper cap portion 66 has an opening therein to permit a portion of pulley-wheels 64 to extend therethrough and additionally to permit passage therethrough of cable 68. It should be understood that upper cap 66 and plates 62 may be connected, or alternatively, formed of one integral piece of material. A bracket 70 (FIG. 2) is mounted above, and is part of, the frame of machine 10. Particularly, bracket 70 fits over bridge assembly 22 such that, in the preferred embodiment, it attaches to each plate 62 and to central upright beam 70.

A cam 72 is pivotally mounted to bracket 70 by pivot pins 74. As shown best in FIGS. 2 and 3, cam 72 is preferably comprised of a first portion 76 connected with, and spaced apart from, a second portion 78. It will be understood that this construction is illustrative of the preferred embodiment, and cam 72 can be constructed in many ways. A spool 80 is rotatably mounted on cam 72, preferably at a location near the outer peripheral edge of cam 72. Preferably, spool 80 is axially mounted between first portion 76 and second portion 78 of cam 72. When cam 72 is in a resting position, spool 80 on cam 72 is positioned substantially in vertical alignment with central pulley-like wheel 64*b*.

It will be appreciated that the cam and spool combination 72, 80 can be constructed in many ways without departing from the principles of the present invention. For instance, cam 72 need not be comprised of first and second portions 76, 78, but could be a solid mass. In such an embodiment, the spool 80 is preferably positioned at one side of the cam 72, or perhaps beneath the cam on a separate bracket assembly mounted to the cam 72. Additionally, it will be appreciated that spool 80 is a means for operably connecting a resistance assembly with cam 72. In the preferred embodiment, spool 80 is a means for engaging cable 68.

A plurality of holes 86 are formed through cam 72. Particularly, holes 86 are positioned such that they form a semicircular array of holes 86 extending from a first location near the edge of cam 72 to a second location near the edge of cam 72. It should be understood that holes 86 are provided in both first portion 76 and second portion 78 of cam 72 such that each hole 86 in one of the portions of cam 72 is aligned with an associated hole in the other portion of cam 72. In other words, and as described more fully below, holes 86 in cam 72, and particularly, corresponding holes 86 in first and second portions 76, 78 of cam 72 provide a path for receipt of a pin used to lock handlebar assembly 82 in a selected fixed resting position.

The handlebar assembly 82 is pivotally attached to cam 72 at pivot point 92. It will be appreciated that handlebar assembly 82 may be pivotally attached at pivot point 92 by various means, such as a removable pin, by rivets, or other types of axial or pivotal mounting mechanisms. In accordance with the principles of the present invention, when handlebar assembly 82 is attached to cam 72 at only the pivot point 92, handle bar assembly 82 is then free to pivot about pivot point 92 and therefore may move relative to cam 72.

In accordance with further principles of the present invention, handlebar assembly 82 is adapted to be selectively connected to cam 72 at one of the plurality of holes 86. Particularly, handlebar assembly 82 is comprised of a bar 84 and a connecting member 87. The bar 84 is gripped by the user while performing various weight-lifting exercises. Foam or rubber-like handgrips are provided on bar 84 for gripping by the user. Connecting member 87 has first and second ends. A first end of connecting member 87 attaches to a central portion of bar 84. A hole (not shown) through connecting member 87 is located at substantially its second end.

Preferably, as shown in FIG. 2, connecting member 87 of handlebar assembly 82 preferably inserts between first and second portions 76, 78 of cam 72. It will be appreciated that machine 10 may be constructed such that handlebar assembly is positioned adjacent one side of cam 72. The location of pivot point 92 on cam 72 is such that holes 86 are positioned about pivot point 92 in a semicircular array. Pivot point 92 is preferably located intermediate the first and second ends of connecting member 87. Further, it is preferred that pivot point 92 and the pivotal position 74 of cam 72 are in substantially the same horizontal plane. The semicircular array formed by the holes 86 is arranged intermediate pivot point 92 and pivot point 72. Such an embodiment provides for a smooth and full range of exercising motion when handlebar assembly 82 is placed in any one of the selected resting positions.

Figure 6:
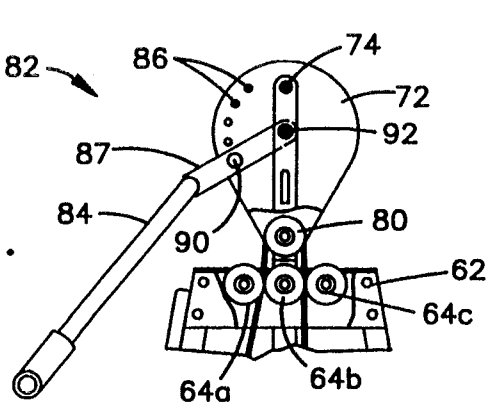
FIG. 6 is illustrative of one alternate embodiment of the cam arrangement of the present invention.
Figure 7:
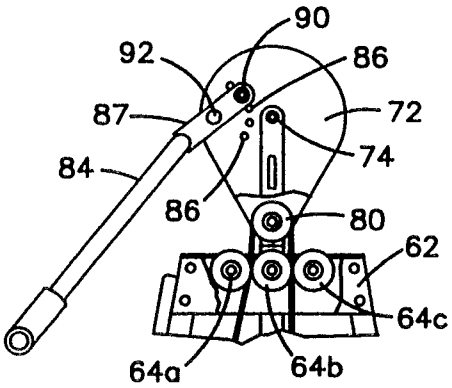
FIG. 7 shows an alternate embodiment of the handlebar assembly used in accordance with the present invention.

It should be understood that pivot position 92 could be located at other locations on cam 72 and relative to an array of apertures. For instance, an array of apertures 86 may be located near the outer peripheral edge of cam 72 about a pivot position for handlebar assembly 82 located intermediate the array and pivot point 74 of cam 72. Additionally, the pivot position of handlebar assembly 82 may be at the same location as pivot position 74 of cam 72. For instance, FIG. 6 is illustrative of an embodiment employing the principles of the present invention in which handlebar assembly 82 pivots about a pivot position 92 on the frame of exercise machine 10, and namely, on bracket 70. Cam 72 pivots about pivot position 74. An array of apertures 86 extend through cam 72 near a peripheral edge of cam 72. In this embodiment, the array of apertures is inverted from that described above and is positioned in an arc. Additionally, the embodiment of FIG. 6 may be altered such that pivot position 92 of handlebar assembly 82 is located on cam 72. As shown in FIGS. 6 and 7, handlebar assembly 82 may be angled between connecting member 87 and handlebar 84, if desired.

Handlebar assembly 82 is set at one position by rotation of handlebar assembly 82 about pivot point until the hole near the second end of connecting member 87 aligns with a selected pair of apertures 86 in first and second portions 76, 78 of cam 72. A pin 90 may then be placed through the aligned holes to hold handlebar assembly 82 in a selected fixed resting location.

Figure 4:
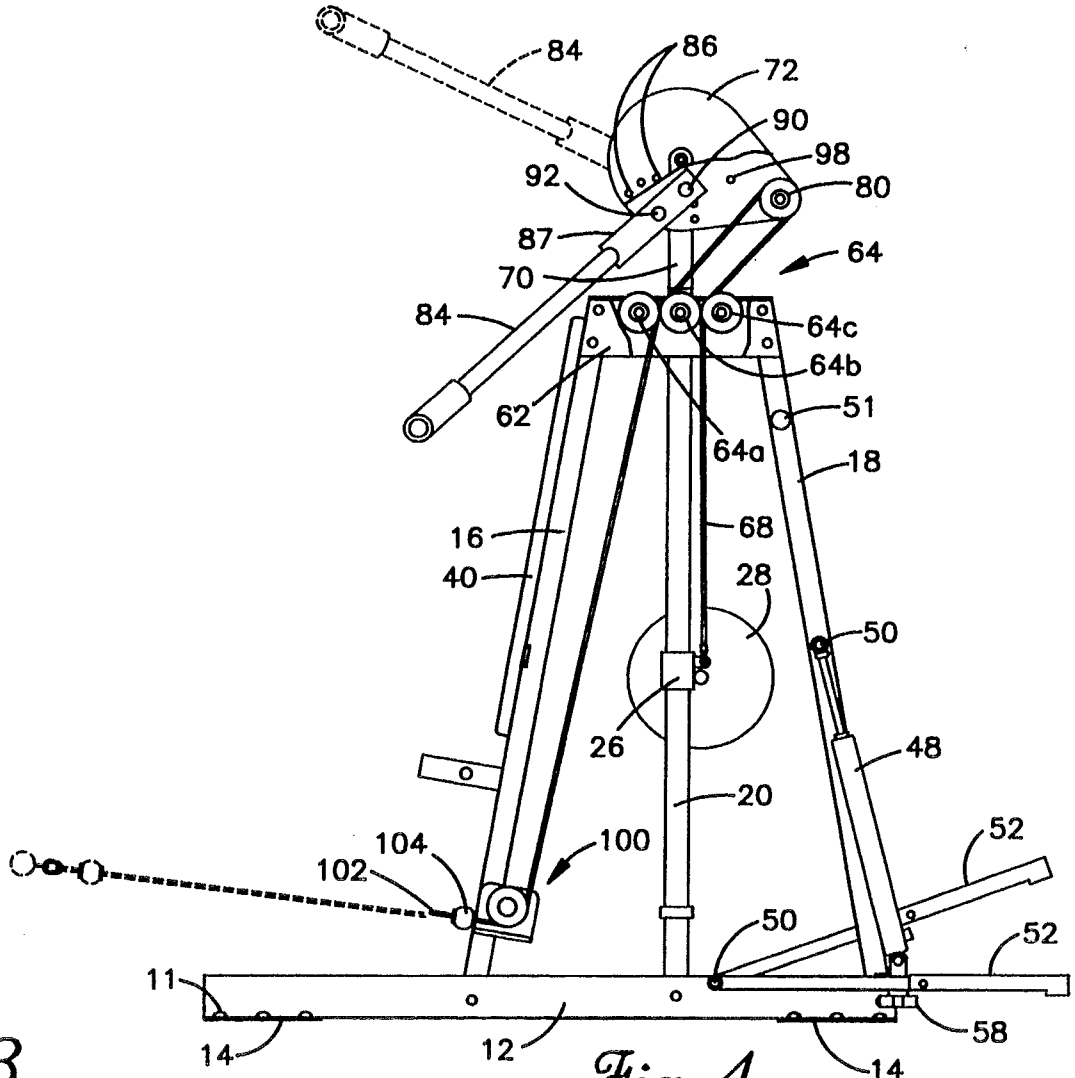
FIG. 4 is a right side elevational view thereof showing the exercising machine in one mode of operation, including broken lines for illustrating movement of various components.
Figure 5:
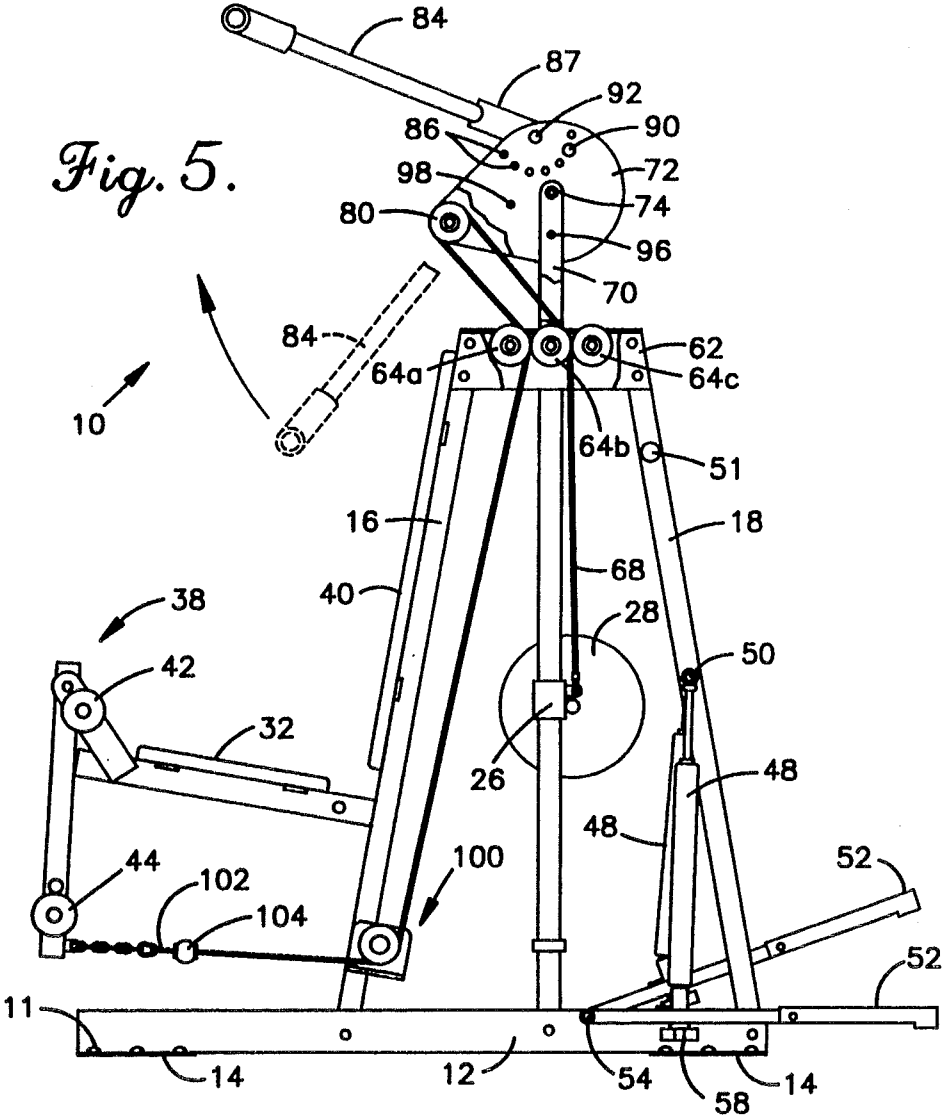
FIG. 5 is a right side elevational view thereof showing the exercising machine in a different mode of operation, including broken lines for illustrating component movement.

Referring to FIGS. 1, 4, and 5, preferred modes of operation of the multiple function exercise apparatus 10 of the present invention are described.

It will be appreciated that the performance of weight-lifting exercises with machine 10 requires movement of a particular component of the device against the resistance of weight assembly 24. Each of the weight-lifting exercises hereinafter described involve movement of a component of machine 10 such that force is applied to cable 68 against the resistance of weight assembly 24.

As shown in FIG. 1, a user may sit in seat 32 for performing leg extension exercises. To perform such an exercise, the user is seated in seat 32 with his or her back against back rest 40. With the lower thigh of each leg positioned under a respective thigh pad 42 and the front portion of each ankle positioned behind a respective ankle pad 44, the legs are extended outwardly thereby forcing leg extension assembly 38 outwardly as shown by dashed lines. During such an exercise, cam 72 is preferably locked in the position shown in FIG. 1 by placement of a pin 94 through an aperture 96 (See FIG. 5) in bracket 70 and an aperture 98 in cam 72. When pin 96 is in place as described, cam 72 remains in a fixed position.

As shown in FIG. 1, as leg extension assembly 38 is moved outwardly from its rest position, cable 68 attached thereto is also drawn outwardly. Cable 68 is partially guided from leg extension assembly 38, through a lower guide post member 100, through an upper guide assembly 64, and particularly between wheels **64*a* and 64*b*, around spool 80 on cam 72, back through upper guide assembly 64, and particularly between wheels 64*b* and 64*c*, and down to weight assembly 24. Accordingly, as cable 68 is drawn outwardly, weight assembly 24 is lifted from its resting position and guided upwardly along central upright member 70**, thereby providing resistance to the legs of the user. Leg extension assembly may be returned to its resting position, preferably with the user continuing to partially resist the now downward motion of the weights, and the process may be repeated.

A related mode of operation of machine 10, although during the performance of different types of exercises, may be carried out by removing seat assembly 32, including leg extension assembly 38, and pulling cable 68 outwardly at its end 102 (i.e., the end opposite the end at which the weight assembly 24 is connected). Particularly, it will be appreciated that the end of cable 68, denoted by reference numeral 102, may be attached to a bar (not shown) in any conventional manner. Pulling the bar outwardly or upwardly will cause the cable to be drawn with it as described above with respect to leg extension assembly 38 thereby lifting the weight assembly 24 from its resting position. An example of an exercise which may be performed using machine 10 in this manner includes upright rows. During this exercise, the user stands straddling base member 12 and facing backrest 40 and lift the bar attached to end 102 of cable 68 upwardly to a location beneath the chin. It will be appreciated that bicep curls may also be performed using the machine in this type of mode. Additionally, seated rows may be performed, during which the user sits on the floor facing machine 10 with his or her feet resting against pedal support rods 54 and pulls the bar attached to end 102 of cable 68 towards the chest. It will be understood that other exercises may also be performed with machine 10 in this mode.

With reference now to FIGS. 4 and 5, further operative modes of machine 10 are described. In FIG. 5, exercise machine 10 is shown in operation during the performance of the well-known bench press exercise. In such an exercise, the user sits in an upright position on seat 36 with his or her back pressed against backrest 40 and presses handlebar 84 outwardly and upwardly. Prior to the exercise, the user positions handlebar assembly 82 in a position for performing the bench press exercise. As described above, this is accomplished by pivoting handlebar assembly 82 about pivot point 92 without pin 90 in place until the hole in connecting member 87 is in alignment with an appropriate pair of apertures 86 in first and second portions 76, 78 of cam 72. Placement of the pin through the aligned holes locks handlebar assembly 82 in place in a desired resting position. For instance, the position of handlebar assembly shown in FIG. 1 may be appropriate in many cases for performing the well-known bench press exercise.

As shown in FIG. 5, handlebar 84 of handlebar assembly 82 begins in a rest position as represented in broken lines. Pressing handlebar 84 outwardly causes cam 72 to rotate about its pivot position 72. It must be understood that, to perform exercises utilizing handlebar assembly 82, pin 94 must be removed from apertures 96 in bracket 70 and aperture 98 in cam 72. Pushing the handlebars outwardly causes the cam to rotate as shown in FIG. 5. Particularly, the outward and upward movement of handlebar assembly 82 rotates cam 72 such that spool 80 is drawn in a direction generally towards the user. During such an exercise, the lower end 102 of cable 68 is attached in a manner so that it will not move in response to movement of handlebar assembly 82. This is preferably accomplished as shown in FIG. 5 wherein cable 68 is attached to leg extension assembly 38, or as shown in FIG. 4 wherein a stopper 104 prevents cable 68 from being drawn through lower guide assembly 100.

As the benchpress exercise is performed, cable 68 is drawn with spool 80 as it moves in conjunction with rotation of cam 72. As shown, cable 68 moves through the upper guide assembly 64 comprised of wheels **64*a*, 64*b*, and 64*c*. Since lower end 102 of cable 68 is fixed, movement as described lifts weight assembly 24. Returning handlebar assembly 82 to its resting position brings weight assembly 24** back down to its resting position.

As shown in FIG. 4, handlebar assembly 82 may be selectively positioned such that other exercises may be performed, such as an exercise commonly referred to as a lat pull-down. To perform such an exercise with machine 10, handlebar assembly 82 is positioned such that the user must pull downwardly on handlebar 84 thereby lifting weight assembly 24. Prior to performing a lat pull-down, handlebar assembly 84 is positioned to align the hole in connecting member 87 with a pair of holes 86 in cam 72 which are vertically lower than the holes 86 used during the bench press exercise. As a result, the resting position of handlebar 84 is at a position like that represented by the broken lines in FIG. 4. Pulling downwardly on handlebar 84 causes cam 72 to rotate about pivot position 74 in a manner such that spool 80 moves from its resting position in a direction generally opposite the user. As described above, this movement causes cable 68 to be pulled along with spool 80 to lift weight assembly 24.

It will be appreciated that various other exercises may be performed by placing handlebar assembly 82 in one of a plurality of rest positions which may be selected and then forcing the handlebar 84 in one of the two general directions in which it moves. For instance, handlebar 10 may be easily moved to a location for performing a military press whereby the user stands with the handlebar 84 generally at shoulder height and lifts directly overhead. Moreover, the ease associated with changing the rest position of handlebar assembly 82 makes machine 10 adaptable for use by persons of various physical stature.

Operation of climbing mechanism 46 is now described. The user stands on climbing pedals 52 such that one foot is on each pedal 52. While grasping handles 51, the user makes a climbing motion by pumping the legs up and down. Pistons 48 attached between the frame at upper piston supports 50 and the pedals 52 provide resistance to the climbing motion. The difficulty of the exercise is variable by changing the location at which the piston 48 couples with pedal 52. Coupling unit 58 attaches the piston 48 to pedal 52 at one of a plurality of apertures 56 located in the pedals. It will be appreciated that movement of the coupling unit 58 will vary the resistance and correspond to the "grade" of the simulated hill being climbed. It is known that a climbing exercise promotes cardiovascular fitness.

As illustrated by the foregoing description, multiple function exercise apparatus 10 of the present invention provides a device which permits the performance of a variety of physical exercises and is easy to convert from one mode of operation to another and which is easy to adjust as desired. Particularly, it has been found that the provision of a cam, in accordance with principles of the present invention, having a first point intermediate its edges about which it may rotate, and a second point near an outer peripheral edge for connection with a resistance means, and a plurality of apertures for selective engagement with means for performing exercises provides an extremely useful component for use during the performance of exercises.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An exercise apparatus comprising:

a frame;

resistance means;

a cam pivotally mounted with respect to said frame at a first location on said cam, said cam operably connected with said resistance means;

a handlebar pivotally mounted to said cam at a second location on said cam; and means for releasably attaching said handlebar with said cam in one of a plurality of fixed resting positions, whereby movement of said handlebar from a fixed resting position causes said cam to pivot thereby actuating said resistance means.

2. The apparatus as set forth in claim 1 wherein said attaching means comprises a plurality of apertures in said cam, an aperture in said handlebar, and a pin for placing through said handlebar aperture and a selected cam aperture with which said handlebar aperture is aligned.

3. The apparatus as set forth in claim 2 wherein said apertures form an array about said second location on said cam.

4. The apparatus as set forth in claim 3, said engaging means further comprising a spool.

5. The apparatus as set forth in claim 4, said resistance means further comprising a cable attached to a weight assembly.

6. The apparatus as set forth in claim 5 wherein said cable is attached at a first end to said weight assembly and at a second end to a fixed location on said exercise apparatus, and whereby an intermediate portion of said cable at least partially engages said spool on said cam.

7. The apparatus as set forth in claim 6 wherein movement of said handlebar from its resting position causes said cam to pivot thereby causing said spool to move from its resting position which in turn pulls said cable thereby causing said weight assembly to move from its resting position.

8. The apparatus as set forth in claim 1 wherein movement of said handlebar in a first direction causes said cam to pivot in a first direction against the resistance means of said resistance assembly and movement of said handlebar in a second direction causes said cam to pivot in a second direction against the force of said resistance means assembly.

9. The apparatus as set forth in claim 1, said exercise apparatus further comprising means mounted on said frame for performing a climbing exercise.

10. The apparatus as set forth in claim 9, said means for performing a climbing exercise comprising first and second pedals pivotally attached to said frame.

11. The apparatus as set forth in claim 1, wherein said cam is pivotally mounted to said frame at said first pivot point near a center of said cam and said handlebar is pivotally mounted to said cam at a second pivot point location radially outward from said first pivot point.

12. An exercise machine comprising:

a frame;

a cam, pivotally mounted on said frame, for rotation about a first location on the cam;

a handlebar, connected to said cam, for rotating the cam about said first location;

resistance means, engaged with said cam at a second location on the cam, for applying a desired force against rotation of said cam by said handlebar, wherein movement of said handlebar rotates the cam which drives said second location on the cam upwardly in an arcuate path.

13. The apparatus as set forth in claim 12 wherein said resistance means further comprises a weight assembly and a cable connected to said weight assembly, wherein said second location on the cam comprises a spool, and wherein said cable engages said spool, whereby moving said handlebar rotates said cam which drives said spool upwardly in an arcuate path and pulls upwardly on said cable thereby lifting said weight assembly.

14. The apparatus as set forth in claim 13 further comprising means for locking said cam in a fixed position to prevent its rotation when said cable is pulled.

15. The apparatus as set forth in claim 13 further comprising a handlebar engaged with said cam whereby movement of said handlebar causes said cam to rotate thereby lifting said weight assembly.

16. The apparatus as set forth in claim 15 further comprising means for releasably engaging said handlebar with said cam in one of a plurality of fixed resting positions.

17. The apparatus as set forth in claim 12 further comprising a climbing assembly mounted on said frame.

18. An exercise apparatus comprising:

a frame;

a seat with a backrest on said frame;

means for resisting movement;

a handlebar, having a starting position, for gripping by a user seated in said seat;

pivoting means pivotally mounted to said frame, said pivoting means engaged with said resisting means and said handlebar whereby movement of said handlebar from said starting position in a first direction rotates said pivoting means in a first direction against the resistance of said resisting means and movement of said handlebar from said starting position in a second direction rotates said pivoting means in a second direction against the resistance of said resisting means.

19. The apparatus as set forth in claim 18 whereby said pivoting means is pivotally mounted to said frame at a first location on said pivoting means and said pivoting means is operably connected to said resisting means at a second location on said pivoting means.

20. The apparatus as set forth in claim 19 wherein said pivoting means is operably connected to said moveable means at said first location on said pivoting means.

21. The apparatus as set forth in claim 20 wherein said pivoting means is operably connected to said moveable means at a third location on said pivoting means.

22. The apparatus as set forth in claim 18 further comprising means for releasably engaging said moveable means with said pivoting means in one of a plurality of fixed resting positions.

23. An exercise apparatus comprising:

a frame having a base and a top bridge assembly connected with support beams;

a cam, pivotally mounted to said top bridge assembly, for rotation about a first pivot point;

a handlebar, connected to said cam, for rotating the cam about said first pivot point;

resistance means connected to said cam, for applying a desired force against rotation of said cam by said handlebar; and attaching means for releasably attaching said handlebar with said cam in one of a plurality of starting positions, wherein moving said handlebar from its starting position in a first direction rotates the cam in a first direction, and moving the handlebar from its starting position in a second direction rotates the cam in a second direction.

24. The apparatus as set forth in claim 23, wherein said attaching means comprises a plurality of apertures through a side of said cam, a hole through said handlebar, and a pin insertable through said hole and a selected one of said apertures with which said hole is aligned.

25. The apparatus as set forth in claim 24, wherein said plurality of apertures form an arcuate array, said handlebar being rotatably connected to said cam at a substantially a central position of said arcuate array.

26. The apparatus as set forth in claim 23, further comprising a spool, rotatably connected to said cam and said resistance means, for providing movement between said cam and resistance means, as said cam rotates.

27. The apparatus as set forth in claim 26, said resistance means comprising a cable attached between a weight assembly and said cam, said weight assembly resisting rotation of said cam.

28. The apparatus as set forth in claim 27, wherein said cable is attached at a first end to said weight assembly and at a second end to a fixed location on said exercise apparatus, an intermediate portion of said cable partially engaging said spool on said cam.

29. The apparatus as set forth in claim 28, wherein movement of said handlebar in a first direction from said resting position rotates said cam which drives said spool upward in an arcuate path and pulls upward on said cable thereby lifting said weight assembly.

30. The apparatus as set forth in claim 23 wherein movement of said handlebar in a first direction pivots said cam in a first direction and movement of said handlebar in a second direction pivots said cam in a second direction.

31. The apparatus as set forth in claim 23, said exercise apparatus further comprising stepping means mounted on said frame for performing a climbing exercise.

32. The apparatus as set forth in claim 31, said stepping means comprising first and second pedals, each of which has one end pivotally attached to said frame and a second end upon which a user stands.

33. The apparatus as set forth in claim 18 wherein said seat is removable, whereby said handlebar is positionable for gripping by a user in a standing position when said seat is removed.

34. An exercise apparatus comprising:

a frame;

a removable seat and a backrest on said frame;

a cam, pivotally mounted to said top bridge assembly, for rotation about a first pivot point;

a handlebar, connected to said cam, for rotating the cam about said first pivot point, said handlebar for engagement by the hands of a user in a seated position in said seat or in a standing position when said seat is removed;

resistance means connected to said cam, for applying a desired force against rotation of said cam by said handlebar; and attaching means for releasably attaching said handlebar with said cam in one of a plurality of starting positions, wherein moving said handlebar from its starting position in a first direction rotates the cam in a first direction, and moving the handlebar from its starting position in a second direction rotates the cam in a second direction.

35. The apparatus as set forth in claim 34 wherein said resistance means comprises at least one weight and a cable, said cable having a first end attached to said at least one weight, a second, free end engageable by a user, and an intermediate portion engaged at said cam, wherein said apparatus further has a lock for preventing rotation of said cam, and wherein said weight provides a desired force against pulling said free end of said cable when said cam is locked.

* * * * *